US007093610B2

(12) United States Patent
Wu

(10) Patent No.: US 7,093,610 B2
(45) Date of Patent: Aug. 22, 2006

(54) OUTDOOR HYDRANT-TYPE WATER FAUCET

(76) Inventor: Hung-Neng Wu, No. 81-1, Goucian Lane, Lugang Township, Changhua County 50567 (TW)

( * ) Notice: Subject to any disclaimer, the term of this patent is extended or adjusted under 35 U.S.C. 154(b) by 40 days.

(21) Appl. No.: 11/018,060

(22) Filed: Dec. 22, 2004

(65) Prior Publication Data

US 2006/0130900 A1 Jun. 22, 2006

(51) Int. Cl.
*E03B 9/04* (2006.01)

(52) U.S. Cl. ..... 137/301; 137/272; 137/291

(58) Field of Classification Search ..... 137/301, 137/272, 291
See application file for complete search history.

(56) References Cited

U.S. PATENT DOCUMENTS 3,407,837 A * 10/1968 Fulton et al. ..... 137/301
6,659,123 B1 * 12/2003 Hyland et al. ..... 137/301

* cited by examiner

*Primary Examiner*—Kevin Lee
(74) *Attorney, Agent, or Firm*—Troxell Law Office, PLLC

(57) ABSTRACT

An improved outdoor hydrant-type water faucet comprised of a water control connector at the top section of a hydrant-type standpipe equipped with a water control connector adjustment fixture and a downwardly extending coupling rod at the bottom section of the hydrant-type standpipe, and a water input valve that opens and closes to vary flow volume. The feature of the present invention is that the hydrant-type standpipe bottom section consists of a wide-mouth sleeve section that provides for the installation therein of a higher specification water input valve having a greater flow volume rating, thereby achieving an increase in water output volume and a reduction in blockage, effectively relieving ice formation and consequent water obstruction due to low temperature outdoors.

2 Claims, 4 Drawing Sheets

OUTDOOR HYDRANT-TYPE WATER FAUCET

BACKGROUND OF THE INVENTION

1) Field of the Invention

The invention herein relates to an improved outdoor hydrant-type water faucet capable of increased water output volume, reduced blockage, and ice formation relief in the water admission portion which consists of a water control connector installed at the top section of a hydrant-type standpipe and a wide-mouth sleeve section of a large inner diameter disposed along its bottom section that provides for the fitting therein of a higher specification water input valve having a greater flow volume rating and thereby effectively relieving ice formation in the water admission portion and consequent water obstruction.

2) Description of the Prior Art

Conventional hydrant-type water faucets in the ground outdoors are necessary devices utilized to facilitate the drawing of water for ground sprinkling, but in such a prior art hydrant-type water faucet (referring to FIG. 1), since the inner diameter of the standpipe 3 is typically the same along its entire length, the water input valve 2 fitted into the bottom section must have the inner circumferential dimensions of a smaller specification valve body and due to the water input valve 2 outer circumference dimensions, the internal passage size of the water control valve element 2A is limited by the smaller inner diameter of the standpipe 3; as a result, the output water flow volume of the said conventional hydrant-type water faucet is subject to a certain degree of limitation; increasing the supplied water volume when needed or a raising the flow volume as required for sprinkling over a wider surface area and at greater depth is not possible; in some frigid zones or regions having seasonal winter low temperature conducive to ice formation, when the internal passage of the water control valve element 2A inside the water input valve 2 is smaller, water remaining in the said position readily freezes, preventing water admission and giving rise to water output blockage; encountering such situations, the user must consider changing to a larger specification water faucet (since the hydrant-type standpipe 3 is entirely of an enlarged fabrication, the water input valve 2 is fabricated at a matching large specification; as such, the structural cost and sales price is higher, and are generally called frostproof faucets), which results in inconvenience and wastefulness that has long existed and await improvement.

SUMMARY OF THE INVENTION

The primary objective of the invention herein is to provide an improved outdoor hydrant-type water faucet in which a water control connector is installed at the top section of a hydrant-type standpipe and a wide-mouth sleeve section is prefabricated contiguously along the lower extent such that its inner diameter is larger than that of the remaining length of the said standpipe, thereby providing for the installation therein of a higher specification water input valve having a greater flow volume rating to achieve increased water output volume, reduced blockage, and ice formation relief in the water admission portion, and that is simple to fabricate, economical, and practical to utilize, which is among the features of the present invention.

DETAILED DESCRIPTION OF THE PREFERRED EMBODIMENTS

Figure 1:
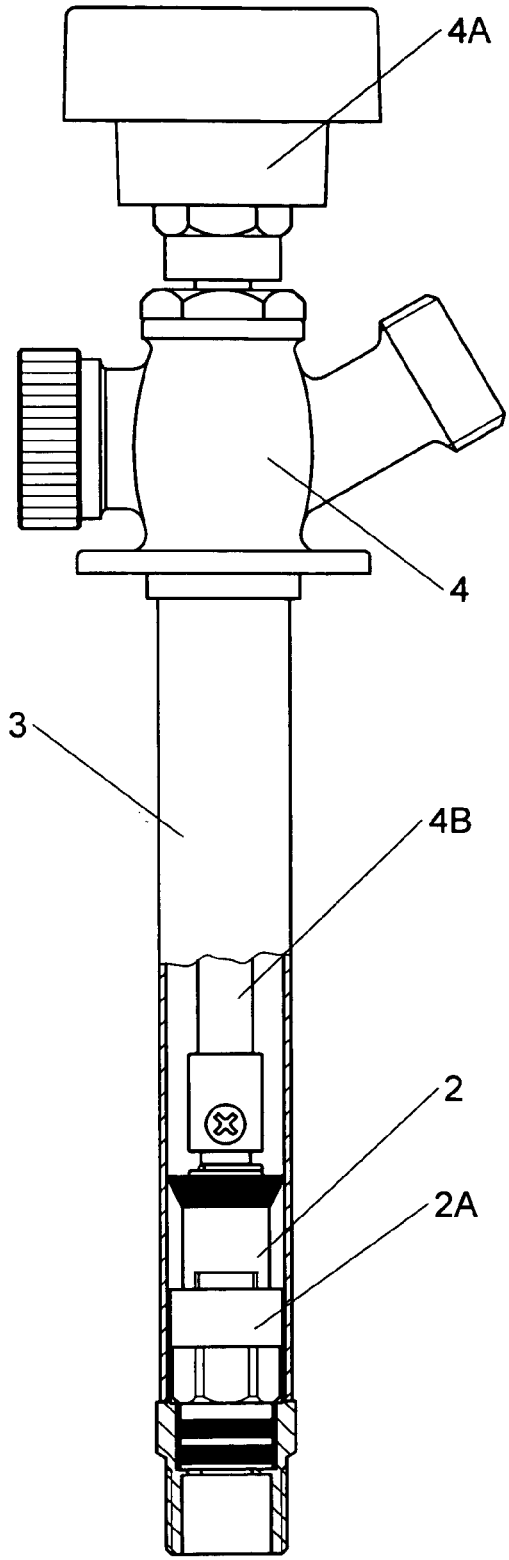
FIG. 1 ( Prior Art )
FIG. 1 is a cross-sectional drawing of the prior art water faucet structure
Figure 2:
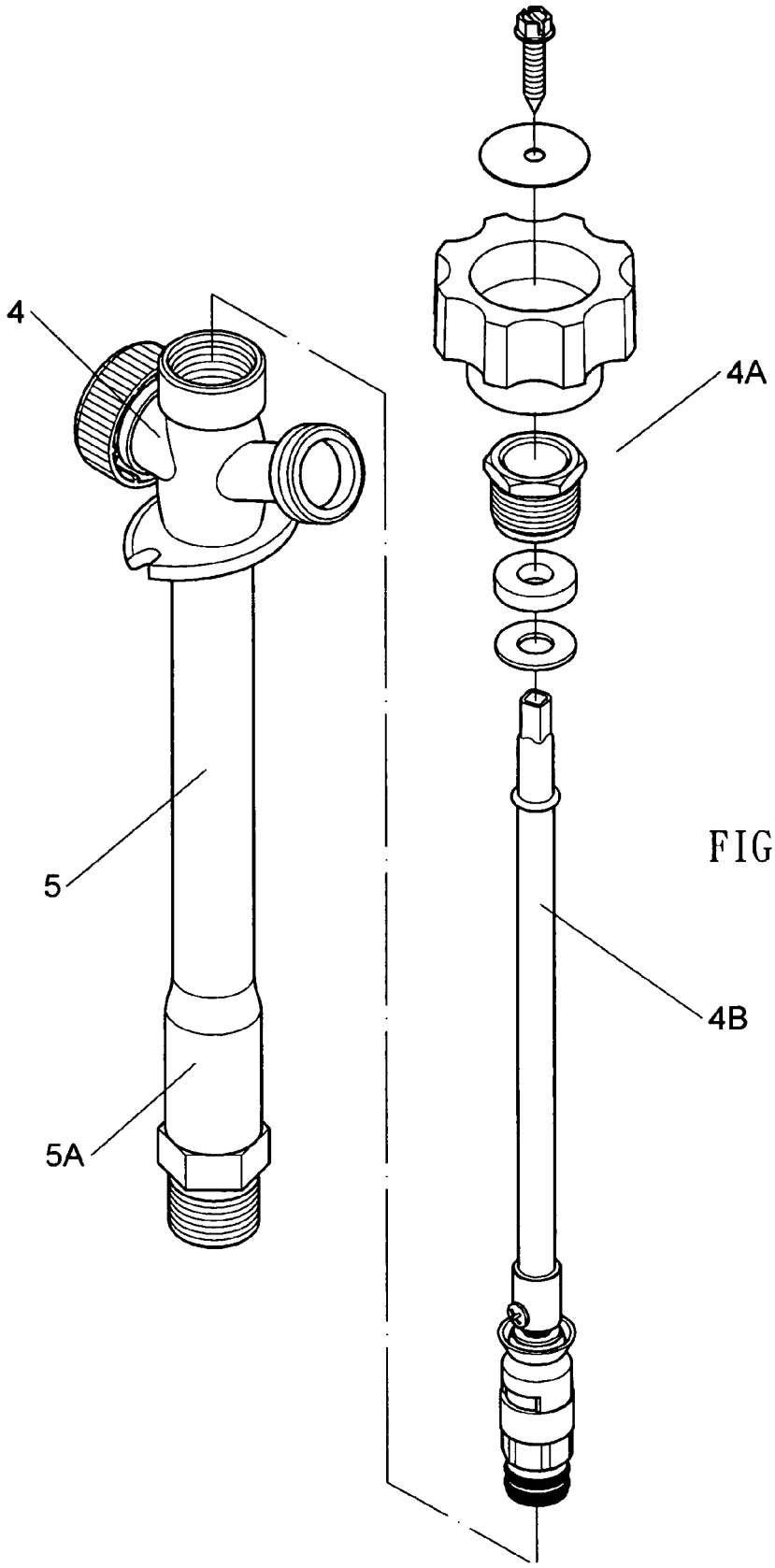
FIG. 2 is an exploded drawing of the structural embodiment of the invention herein.
Figure 3:
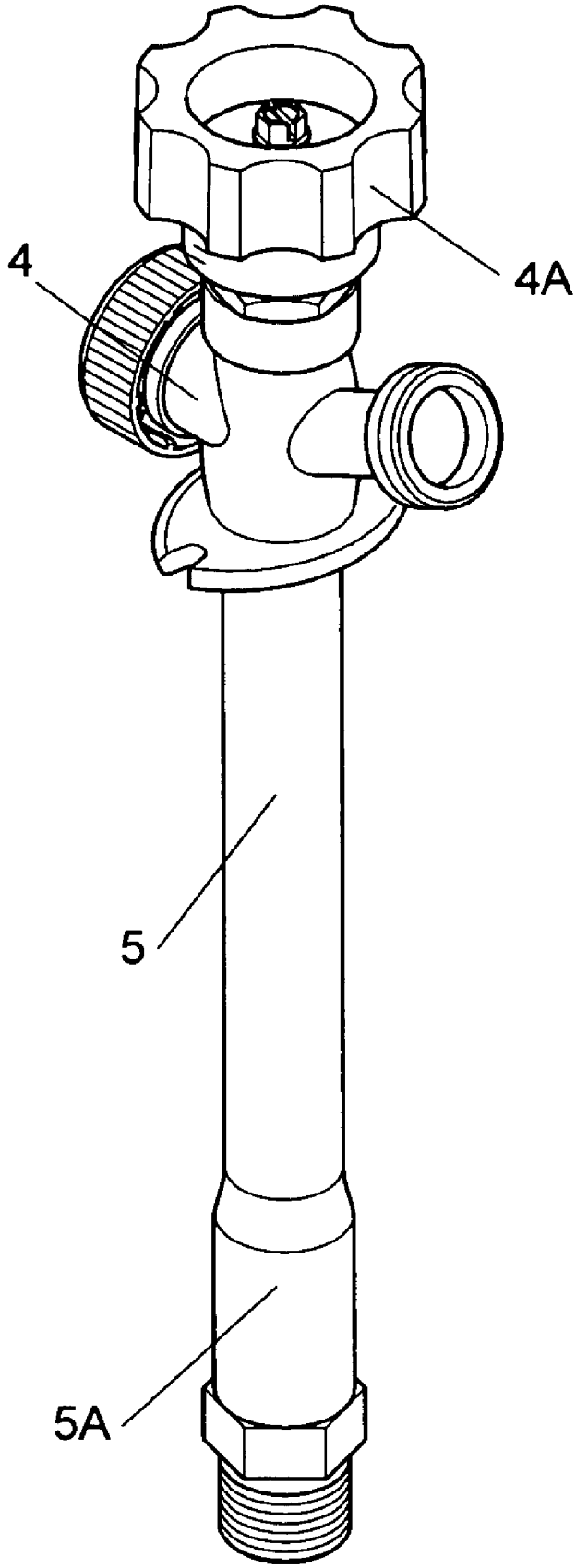
FIG. 3 is an isometric drawing the structural embodiment of the invention herein.
Figure 4:
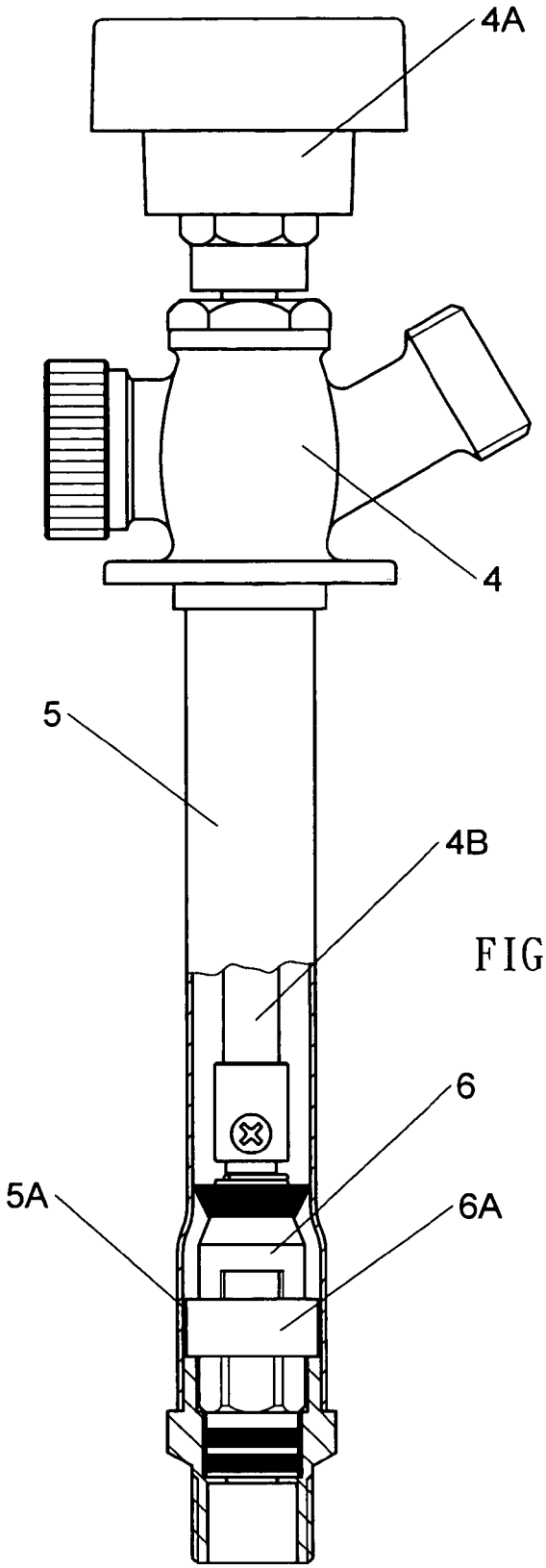
FIG. 4 is a cross-sectional drawing of the structural embodiment of the invention herein.

The disclosure of the structural embodiment and application of the invention herein is accompanied by the said drawings for reference; referring to FIG. 2, FIG. 3, and FIG. 4, the invention herein is comprised of a water control connector 4 at the top section of a hydrant-type standpipe 5 equipped with a water control connector 4 adjustment fixture 4A and a downwardly extending coupling rod 4B at the bottom section of the hydrant-type water supply pipe 5, and a water input valve 6 that opens and closes to vary flow volume, the feature of which is: The hydrant-type standpipe 5 bottom section consists of a wide-mouth sleeve section 5A prefabricated contiguously along the lower extent such that its inner diameter is larger than that of the remaining length of the said standpipe 5, thereby providing for the installation therein of a higher specification water input valve 6 having a greater flow volume rating.

In the said structure, since the water control valve element 6A passage through the higher specification water input valve 6 is of a larger rating and a greater water flow volume is conveyed through it, water output volume is increased and blockage is reduced, thereby providing for enhanced functional utility.

Furthermore, the larger rating of the water control valve element 6A passage is such that water is left in the said portion of water admission and when the said structure is utilized under low temperature conditions in frigid zones, during the winter, or in other regions where freezing readily occurs, ice formation is effectively relieved due to greater water admission and flow volume; as a result, obstruction does not occur when water is drawn for usage.

In summation of the foregoing section, since the outdoor hydrant-type water faucet provided by the invention herein is convenient in that no modification is required for installation and, furthermore, has a high flow volume, is not easily obstructed, and is frostproof, the present invention meets new patent application requirements.

The invention claimed is:

1. An outdoor hydrant-type water faucet comprising:

a) a standpipe having a main section and a wide-mouth sleeve section, the main section and the wide-mouth sleeve section are integrally formed, the wide-mouth sleeve section being located on a bottom of the standpipe, the wide-mouth sleeve section having an internal diameter larger than an internal diameter of the main section;

b) a water input valve movable between open and closed positions and having a water control valve element located in and engaging an internal surface of the wide-mouth sleeve section of the standpipe; and c) a water control connector having:

i) an adjustment fixture located on a top of the standpipe and controlling the water input valve; and ii) a coupling rod having a first end connected to the adjustment fixture and a second end connected to the water input valve.

2. The outdoor hydrant-type water faucet according to claim 1, wherein the water control valve element has a outer diameter larger than the diameter of the main section of the standpipe.

* * * * *